US007069848B2

(12) United States Patent
Brees

(10) Patent No.: US 7,069,848 B2
(45) Date of Patent: Jul. 4, 2006

(54) MOBILE APPARATUS FOR CRUSHING CONTAINERS

(76) Inventor: Theodore H. Brees, P.O. Box 816, Kaufman, TX (US) 75412

( * ) Notice: Subject to any disclaimer, the term of this patent is extended or adjusted under 35 U.S.C. 154(b) by 24 days.

(21) Appl. No.: 10/867,461

(22) Filed: Jun. 14, 2004

(65) Prior Publication Data

US 2006/0086264 A1 Apr. 27, 2006

(51) Int. Cl.
*B30B 1/00* (2006.01)
*B30B 9/00* (2006.01)

(52) U.S. Cl. ..... 100/214; 100/94; 100/100; 100/110; 100/229 R; 100/902

(58) Field of Classification Search ..... 100/94, 100/100, 110, 214, 229 R, 902; 144/193.1, 144/193.9
See application file for complete search history.

(56) References Cited

U.S. PATENT DOCUMENTS

| | | | | |
|---|---|---|---|---|
| 2,875,912 | A * | 3/1959 | Thresher et al. | 414/622 |
| 3,242,851 | A | 3/1966 | Brawley | |
| 3,593,654 | A | 7/1971 | Mayfield | |
| 3,691,945 | A | 9/1972 | Guhl | |
| 3,773,202 | A * | 11/1973 | Dutra, Jr. | 414/622 |
| 3,838,637 | A | 10/1974 | Gulh | |
| 3,949,890 | A * | 4/1976 | Keller | 414/810 |
| 4,334,469 | A | 6/1982 | Tanner | |
| 4,549,845 | A | 10/1985 | Ramsey, Jr. | |
| 5,092,234 | A | 3/1992 | Von Rohr | |
| 5,341,731 | A | 8/1994 | Grizzard, Jr. | |
| 5,371,911 | A | 12/1994 | Mullinax | |
| 5,456,167 | A | 10/1995 | George | |
| 5,461,973 | A | 10/1995 | Page | |
| 5,553,535 | A | 9/1996 | Lucas | |
| 6,581,647 | B1 | 6/2003 | Leidlein | |
| 2002/0044828 | A1 | 4/2002 | Olynyk | |
| 2003/0155037 | A1 | 8/2003 | Alexander | |
| 2003/0230360 | A1 | 12/2003 | Setlack | |

FOREIGN PATENT DOCUMENTS

| | | | |
|---|---|---|---|
| DE | 2515158 A | * | 10/1976 |
| EP | 392842 A1 | * | 10/1990 |
| JP | 58218399 A | * | 12/1983 |
| SE | 8701994 A | * | 11/1988 |

* cited by examiner

*Primary Examiner*—Derris H. Banks
*Assistant Examiner*—Jimmy T. Nguyen
(74) *Attorney, Agent, or Firm*—Cash Klemchuk Powers Taylor LLP; Darin M. Klemchuk

(57) ABSTRACT

The present invention provides a mobile crusher for crushing containers such as 55-gallon drums. The apparatus includes a crusher head and crusher base, each of which are quickly and easily attached to a forklift. When actuated, the forks of the forklift drive the crusher base and container resting on it into the crusher head, thereby crushing the container. The apparatus may be configured to accommodate different sizes of forklifts and may include an optional device to puncture the container at the onset of the crushing action.

12 Claims, 6 Drawing Sheets

MOBILE APPARATUS FOR CRUSHING CONTAINERS

BACKGROUND OF THE INVENTION

1. Field of the Invention

The present invention relates generally to apparatus for crushing objects and containers and in particular to a mobile apparatus for crushing 55-gallon drums and other containers to facilitate disposition of those containers.

2. Description of Related Art

Containers, such as 55-gallon drums, are bulky even when empty and frequently require some form of compacting or crushing to enhance disposal or recycling. A typical 55-gallon drum is approximately 35 inches in length and 24 inches in width. By crushing the drum, it can be reduced to approximately 8 inches in thickness, thereby saving storage space and increasing the number of containers that can be shipped for disposal or recycling within a vehicle or shipping unit.

Container crushers are well known in the art. But prior-art crushers generally require some form power such as hydraulic power to crush the containers placed in them. One example of this type of crusher is described in U.S. Pat. No. 5,461,973 issued to Page. The '973 patent employs remote controlled hydraulics to drive a ram press into the container sought to be crushed. This apparatus, however, is bulky and therefore cannot be easily moved to various locations at a typical worksite in which empty containers are ordinarily found. In addition, due to its complexity, a crusher manufactured according to the '973 patent would also be expensive.

The drum crusher described in U.S. Pat. No. 5,341,731 to Grizzard presents an improvement over the '973 patent. In the '731 patent, the crusher is attached to a two-wheeled trailer. The inclusion of the trailer enhances the mobility of the drum crusher. But, as with the '973 patent, the crusher requires complex machinery and its own power source. This complexity and the requirement of an integral power source necessarily adds to the bulk and cost of such a crusher.

Therefore, a need exists for a simple, inexpensive, and mobile container crusher capable of crushing containers of varying sizes, including 55-gallon drums. A need also exists for a container crusher that utilizes the power source of other machinery commonly present at a worksite so that crusher is not required to have an additional integral power source.

All references cited herein are incorporated by reference to the maximum extent allowable by law. To the extent a reference may not be fully incorporated herein, it is incorporated by reference for background purposes and indicative of the knowledge of one of ordinary skill in the art.

SUMMARY

The problems presented in prior art are solved by the apparatus of the present invention, which is directed to a mobile container crusher. The present invention includes a crusher head and crusher base, adapted to be easily connected to a forklift. The crusher head has a head plate, for crushing a container pressed against the head plate, and a side plate or mounting member, for mounting the head plate to the frame of a forklift. The crusher base has at least one channel, configured to accept at least one fork of the forklift, and a base plate, connected to the channel for supporting the container while the forks of the forklift are actuated and driven toward the crusher head. The invention is an advancement in the art by providing a mobile container crusher achieving the objects listed below.

It is an object of the present invention to provide a mobile container crusher that may be easily and quickly attached to a forklift.

It is another object of the present invention to provide a mobile container crusher capable of using the power source of machinery commonly present at a worksite, such as forklifts, to crush containers such that it does not require its own hydraulics or other machinery to be operable.

It is another object of the present invention to provide a mobile container crusher capable of accommodating various sizes of forklifts.

It is another object of the present invention to provide a mobile container crusher that employs a device to puncture the container at the onset of crushing to further stabilize the container and facilitate the release of air and other gases from the container during crushing.

Other objects, features, and advantages of the present invention will become apparent with reference to the drawings and detailed description that follow.

DETAILED DESCRIPTION OF THE PREFERRED EMBODIMENT

In the following detailed description of the preferred embodiments, reference is made to the accompanying drawings, which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical and other changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
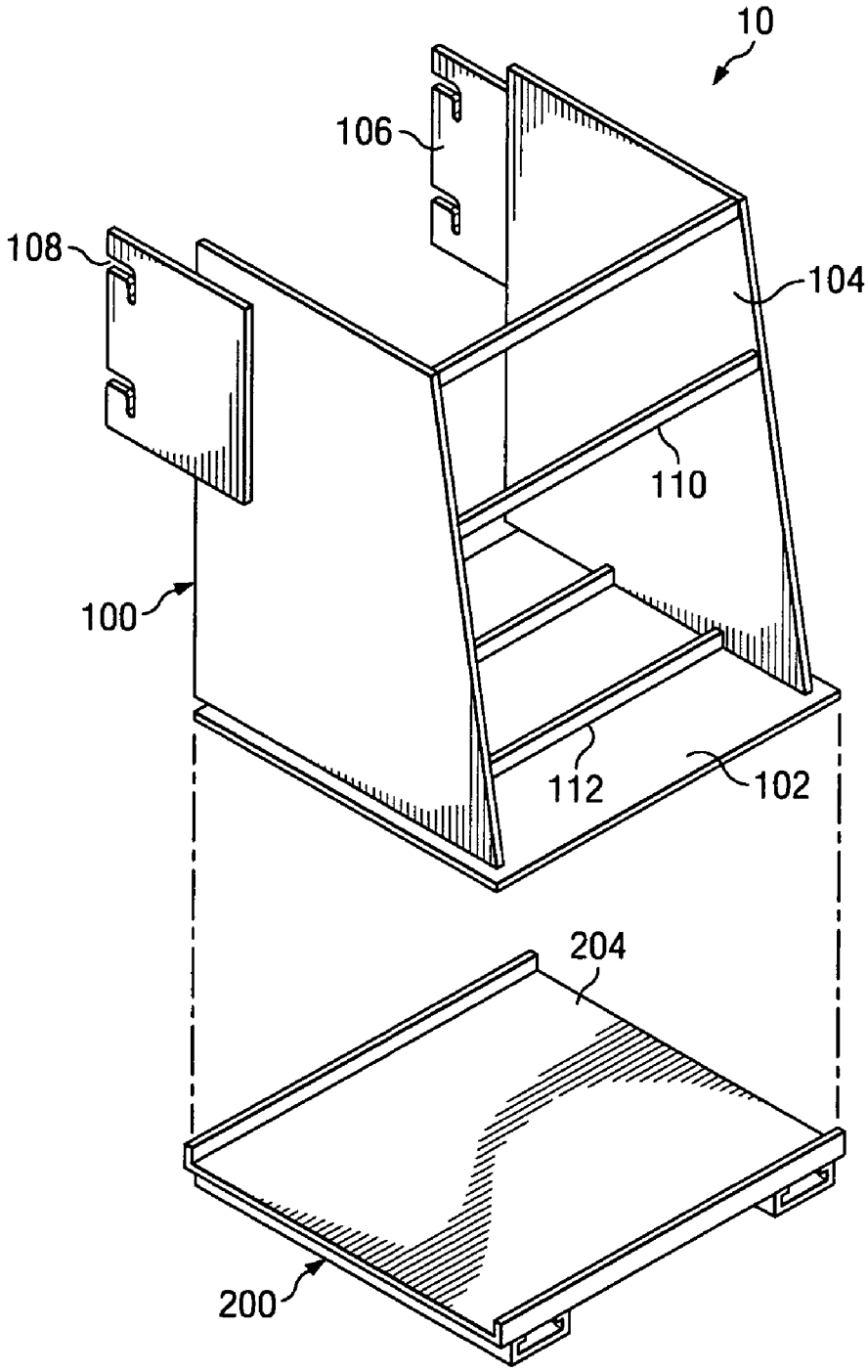
FIG. 1 is a perspective view of the present invention illustrating the crusher head 100 and crusher base 200 of the mobile container crusher 10.
Figure 2:
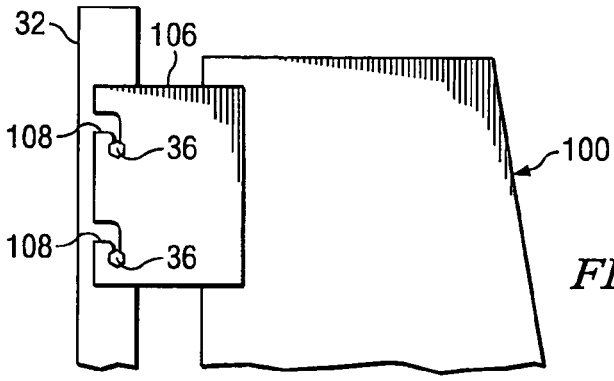
FIG. 2 is a side view of the present invention illustrating the attachment of the crusher head 100 to the frame 32 of the forklift.
Figure 3:
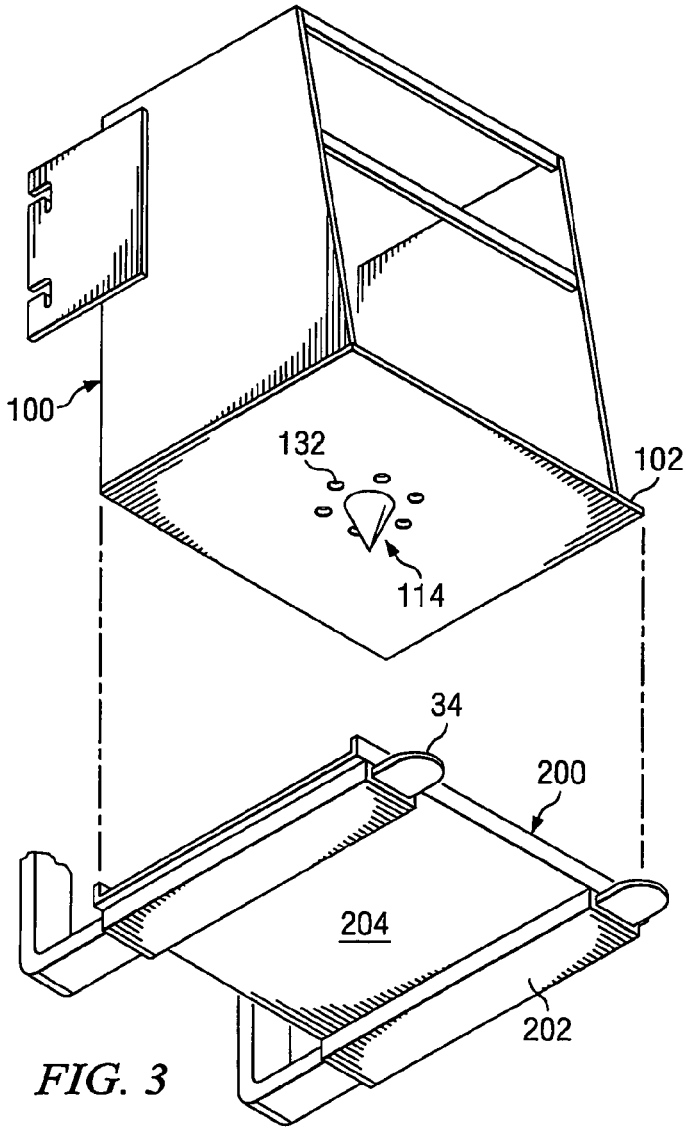
FIG. 3 is a perspective view looking upward of the present invention illustrating the crusher head 100 and crusher base 200 (installed on forks 34 of a forklift) of the mobile container crusher, showing optional angle member 114 and discharge holes 126.
Figure 4:
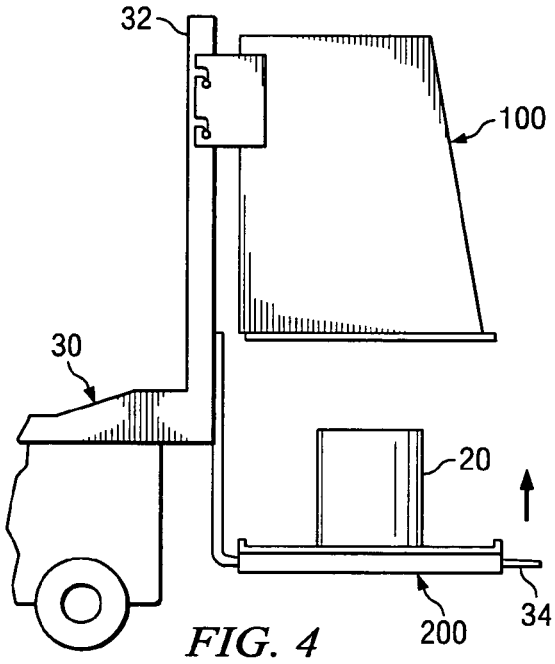
FIG. 4 is a side view of the present invention illustrating the mobile container crusher 10 installed on a forklift 30 in an initial stage of operation.
Figure 5:
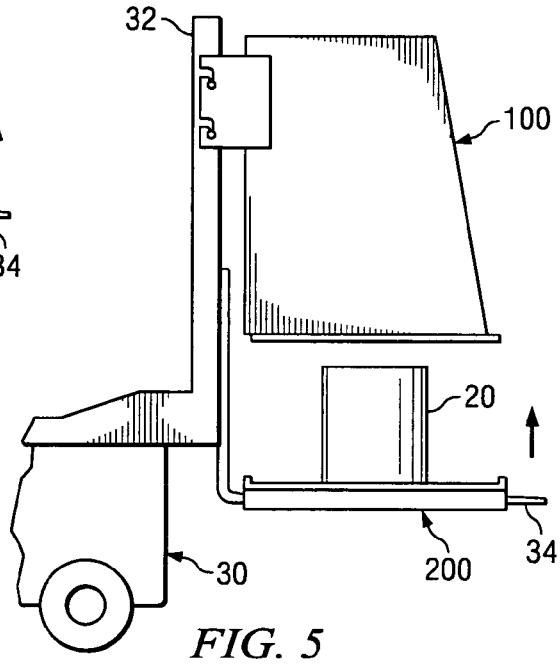
FIG. 5 is a side view of the present invention illustrating the mobile container crusher 10 installed on a forklift 30 in an intermediate stage of operation.
Figure 6:
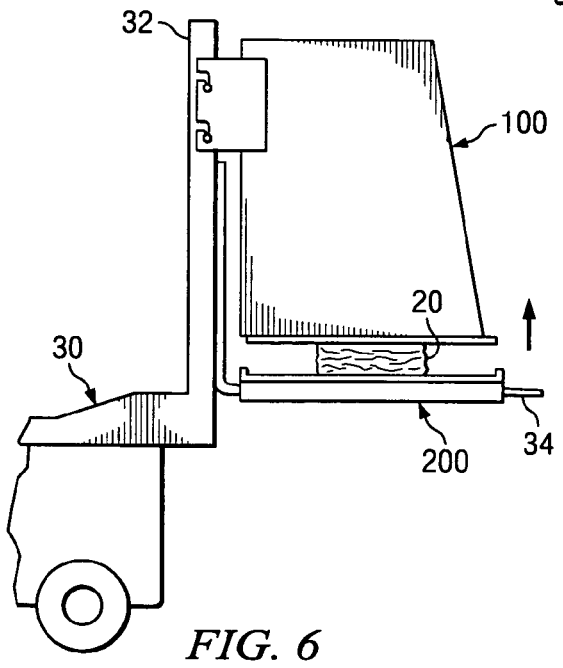
FIG. 6 is a side view of the present invention illustrating the mobile container crusher 10 installed on a forklift 30 in the final crushing stage of operation.

Referring to FIG. 1, the mobile crusher 10 includes a crusher head 100 and crusher base 200. FIGS. 2 and 3 illustrate the installation of the mobile crusher 10 on a forklift 30. As shown in FIG. 2, the crusher head 100 is attached to the frame 32 or other structure of the forklift 30. Turning to FIG. 3, the crusher base 200 is attached to the forks 34 of the forklift 30. The container 20 or other object desired to be crushed is placed on the upper surface of the crusher base 200. As shown in FIGS. 4, 5, and 6, when the forklift 30 is actuated, the forks 34 are driven upward causing the container 20 to come into contact with the crusher head 100. The compression between the crusher head 100 and crusher base 200 crushes the container 20.

In the preferred embodiment, the crusher 10 is configured to be easily removed from the forklift 30. The crusher head 100 is designed to be mounted on the frame 32 of a forklift 30 using mounting members 106. Turning to FIG. 2, in one embodiment, the crusher head 100 is mounted to the frame 32 by a fastener 36, such as a bolt, attached to the frame 32. FIG. 2 illustrates the attachment of a mounting member 106 to frame 32 of the forklift 30. The bolt 36 is inserted into the slot 108 of the mounting member 106. The invention, however, is not limited to the use of bolts. Other fasteners commonly-known in the art, such as studs, may also be used. In addition, slots 108 are not required. The mounting member 106 may include a hole, instead of a slot, for accepting the fastener. Alternatively, the mounting member 106 also may be permanently mounted or affixed to the frame 32 of the forklift.

In the preferred embodiment, four slots and bolts are used to install the crusher head 100 to the forklift 30. L-shaped slots 108, as shown in FIG. 2, are preferred to allow the crusher head 100 to slide horizontally over the fasteners 36 to facilitate installation. Other shapes of slots, such as a simple horizontal-oriented slot or a hole, may also be used. The L-shaped slot 108 may be elongated in the vertical direction either upward or downward from the axis of the horizontal portion of the slot. Where the slots 108 are elongated upward, the weight of the crusher head 100 will cause it to move downward as the fastener 36 is moved into the vertical portion of the slot 108. This movement will contribute to securing the crusher head 100 to the frame 32 of the forklift 30. The L-shaped slot 108 may also be elongated downward relative to the axis of the horizontal portion of the slot 108.

The crusher base 200 is also configured to be easily installed on and removed from the forklift 30. Referring to FIG. 3, the crusher base 200 includes at least one channel 202 and a base plate 204. The fork 34 of forklift 30 is inserted into the channel 202. This allows the crusher base 200 to be stably supported by the forks 34 during operation of the forklift 30. One skilled in the art would appreciate that either one or more channels may be used. In the preferred embodiment, the crusher base 200 has two channels 202 to accommodate each of the forks 34 of the forklift 30. The channels 202 should be of sufficient width to accommodate varying sizes of forklift forks 34. Also, a single channel 202 may be utilized. The channel 202 should be of sufficient width to accommodate at least one fork 34 of the forklift 30. The channel 202 may optionally be wide enough to accommodate both forks 34 of the forklift 30.

Turning to FIG. 1, the crusher head 100 includes a head plate 102 and at least one side plate 104. The side plate 104 includes a mounting member 106. In one embodiment, the side plate 104 is attached to the head plate 102 and mounts the crusher head 100 to the frame 32 of the forklift 30. One skilled in the art would appreciate that the side plate 104 and mounting member 106 may be constructed of a single continuous member or may be constructed from a plurality of members. In the preferred embodiment, the crusher head 100 include two side plates 104. In this embodiment, the mounting member 106 is an additional plate attached to the side plate 104. The head plate 102, mounting member 106, and side plate 104 should be constructed of rigid materials, such as steel, iron, metallic alloys, and other rigid materials and the like. One skilled in the art would appreciate the numerous alternative materials that may be used to construct these elements.

In the preferred embodiment, the crusher head 100 includes an angle member 114 attached to the lower surface of the head plate 102. The angle member 114 should be formed from rigid materials and shaped to include at least one sharp angle so that it can pierce the container 30 during the crushing operation. Although the angle member 114 is not required, it enhances stability by piercing the container 30 and thereby, providing an additional means for holding the container 30 in place during crushing. It also allows for the escape of air as the container 30 is crushed. Additionally, discharge holes 132 as shown in FIG. 3 may be included to facilitate the discharge of air and other gases and possibly fluids during the crushing of the container 30.

Figure 9:
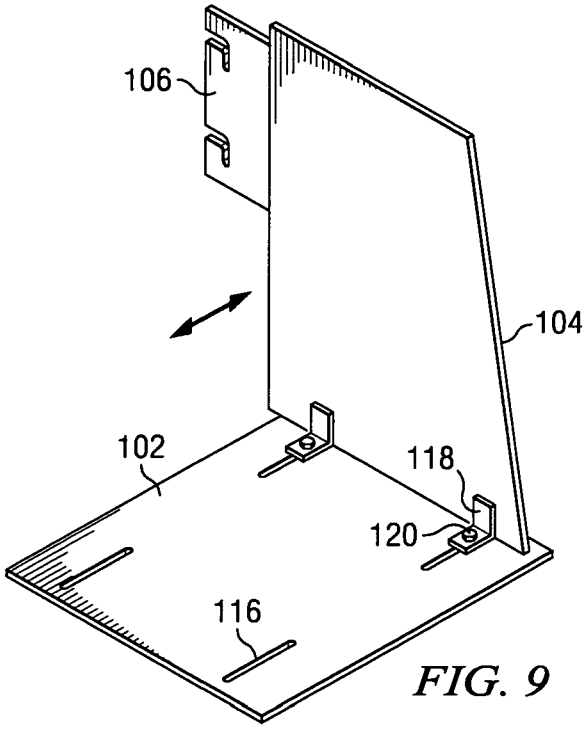
FIG. 9 is a perspective view of another embodiment of the present invention illustrating slots 116 in the head plate 102 allowing for adjustment of the width between the side plates 104.
Figure 10:
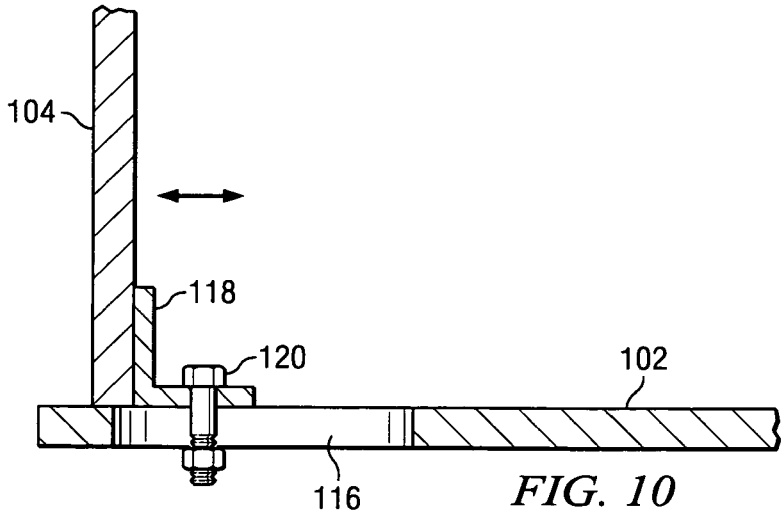
FIG. 10 is a side view of an embodiment of the present invention illustrating the installation of side plate 104, bracket 118, and head plate 102 through optional slots 116 in the head plate 102.
Figure 11:
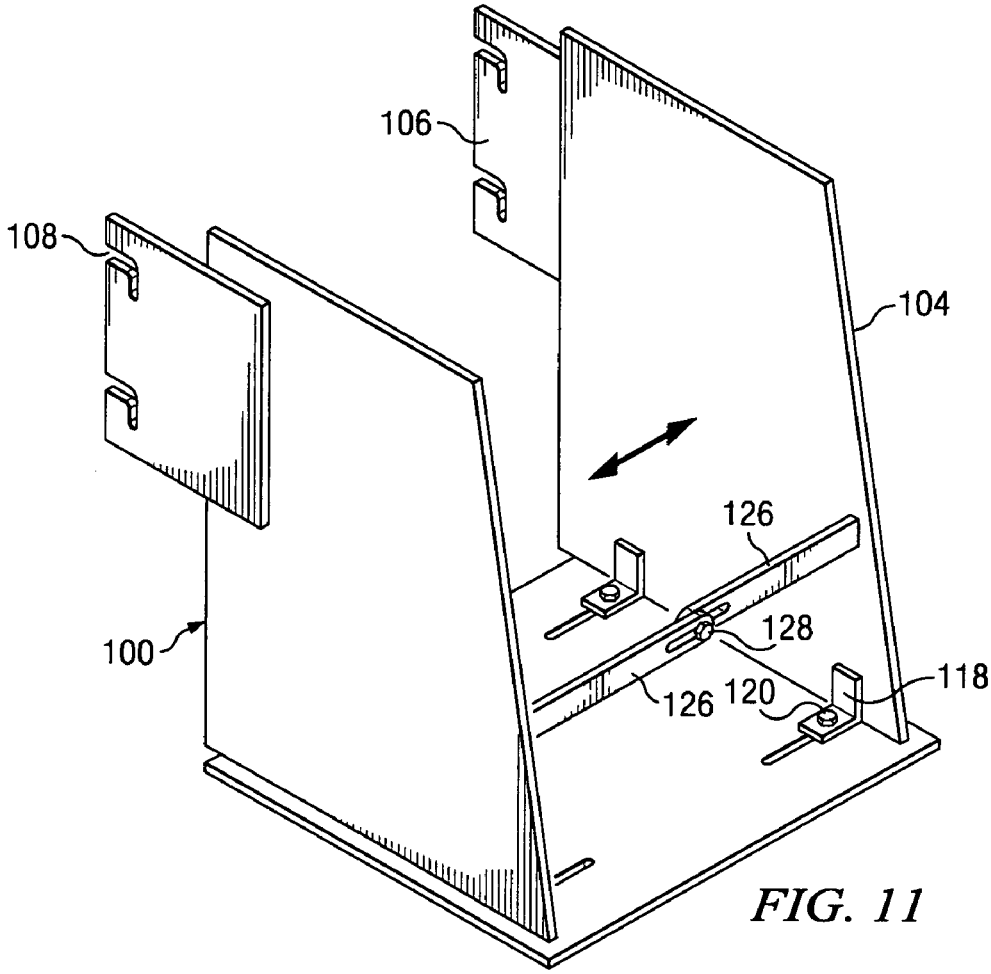
FIG. 11 is a perspective view of an embodiment of the present invention illustrating adjustable side plates 104 and optional adjustable support member 126.
Figure 12:
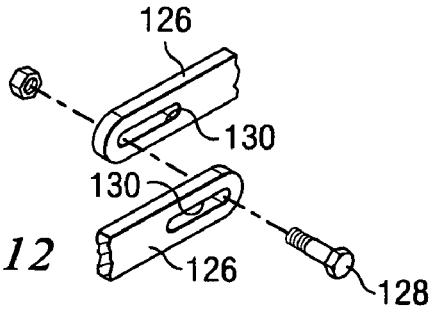
FIG. 12 is an exploded view of optional adjustable support members 126 and fastener 128.

In another embodiment of the invention, at least one slot 116 is included in the head plate 102. FIG. 9 illustrates an embodiment with four slots 116 oriented perpendicular to the plane of the side plates 104. The slots 116 allow the width between the side plates 104 to be adjusted to accommodate varying widths of forklift frames 32. As shown in FIG. 10, two brackets 118 are attached to each side plate 104. A fastener 120 is inserted through each slot 116 and fastened to the bracket 118. By loosening the fastener 120 of each bracket 118, the slide plate 104 may be moved laterally in a direction perpendicular to its plane. One skilled in the art would appreciate a single slot 116 in the head plate could be used to adjust each side plate 104, or that one or more slots 116 could be used for each slide plate 104. This embodiment may include additional optional adjustable support members 126. As shown in FIGS. 11 and 12, at least one of the adjustable support members 126 has a slot 130 in it. The adjustable support members 126 are secured via a fastener 128 installed through the slot 130. This mechanism allows the adjustable support members 126 to vary in width as the side plates 104 are adjusted.

Figure 7:
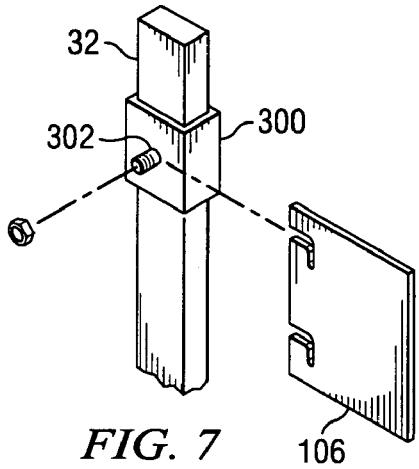
FIG. 7 is an exploded view of an embodiment of the present invention illustrating how the mounting member 106 is attached to the frame 32 of the forklift via a mounting collar 300 and fastener 302.

In another embodiment of the invention, the mounting member 106 of the crusher head 100 is attached to the forklift frame 32 by a mounting collar 300. FIG. 7 illustrates the installation using a mounting collar 300. The mounting member 106 is connected to the mounting collar 300 by the fastener 302. Preferably, the mounting collar 300 is installed securely over the frame 32 or some other structure of the forklift 30. One skilled in the art would appreciate the multitude of different manners in which this may be accomplished. One example includes using a collar 300 that employs a fastener (not shown) that attaches to the frame 32 of the forklift 30 to securely hold the collar to the frame. In another example, the collar 300 is welded to the frame 32.

Figure 8:
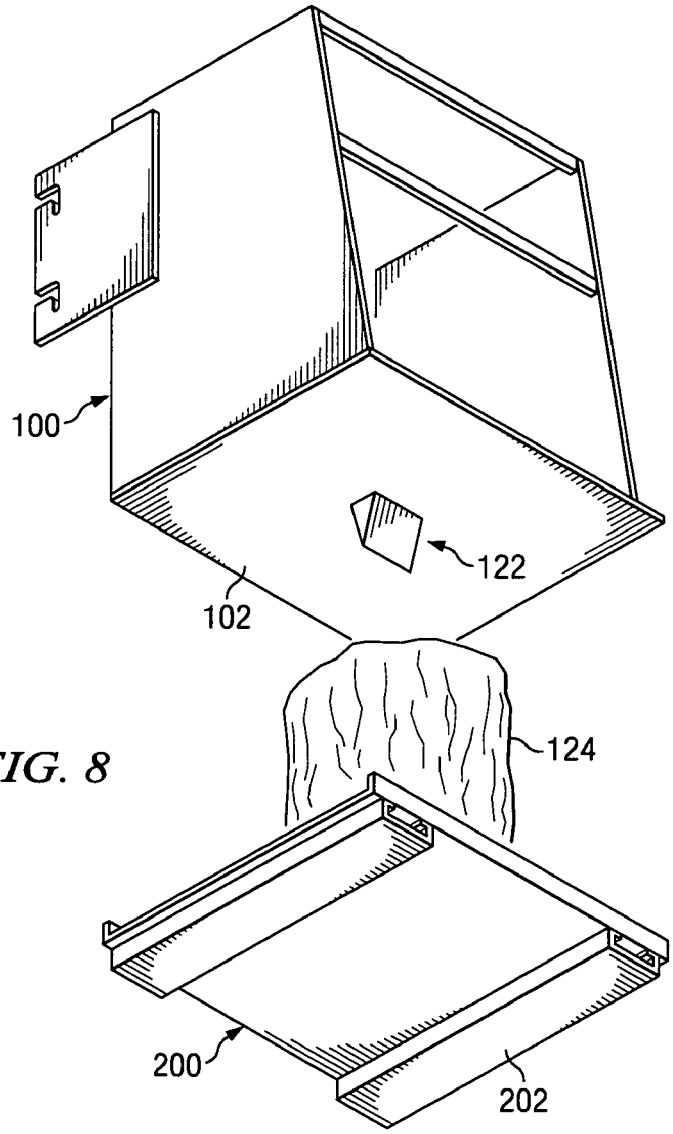
FIG. 8 is a perspective view of an embodiment of the present invention illustrating the installation of an optional wood splitter member 122.

In another embodiment, as shown in FIG. 8, the crusher 10 includes an optional wood splitter member 122 for facilitating the splitting of wood placed between the crusher head 100 and the crusher base 200. The wood splitter member 122 should be manufactured from rigid or hard materials and have some form of angle shape such as that of an ordinary axe or may have multiple angle members. One skilled in the art would appreciate the multitude of different shapes that may be used for the wood splitter member 122.

The primary advantage of the present invention is that the crusher can effectively crush containers, such as 55-gallon drums, using a common forklift. Because it does not require its own power source, the crusher is not cumbersome and is relatively inexpensive to manufacture. It is also mobile and relatively easy to transport to a worksite. Another advantage of the invention is that it is adapted to be easily and quickly installed on and removed from a forklift. It may also be configured to accommodate different sizes of forklifts.

Even though many of the examples discussed herein are applications of the present invention in compaction, the present invention also can be applied to other types of waste compaction, including but not limited to 55-gallon drums. One skilled in the art will see that the present invention can be applied in many areas where there is a need to crush containers or objects. Other applications of the invention include: compaction of appliances, compaction of oil and air cleaners and filters, and compaction of salvage automobiles.

It should be apparent from the foregoing that an invention having significant advantages has been provided. While the invention is shown in only a few of its forms, it is not just limited but is susceptible to various changes and modifications without departing from the spirit thereof.

I claim:

1. A mobile apparatus for crushing a container comprising:

(a) a crusher head having, a head plate for crushing a container pressed against the head plate, two side plates connected to the head plate, and at least two fasteners for securing the side plates to a frame of a forklift; and (b) a crusher base having, at least one channel configured to accept a fork of the forklift, and a base plate connected to the channel for supporting the container while the fork of the forklift is actuated and driven toward the crusher head, thereby crushing the container.

2. The apparatus of claim 1, wherein the head plate contains at least one slot oriented perpendicular to the plane of the side plates for allowing the distance between the side plates to be adjusted, and includes at least one bracket attached to each side plate, on one end, and the head plate, on the other end, and a fastener inserted through the slot to attach the bracket to the head plate.

3. The apparatus of claim 2 additionally including a support member connected on one end to the first side plate and connected on the other end to the second side plate, wherein the support member is comprised of two arm members, wherein at least one of the arm members has a slot substantially parallel to the longitudinal side of the arm member and located near one end of the arm member.

4. The apparatus of claim 2 additionally including an angle member attached to the lower surface of the head plate for piercing the container.

5. The apparatus of claim 2 wherein, the head plate additionally includes discharge holes.

6. The apparatus of claim 2 additionally including a wood splitter member attached to the lower surface of the head plate for splitting wood placed on the upper surface of the crusher base when the forks of the forklift are actuated and driven toward the crusher head.

7. The apparatus of claim 2 additionally including a mounting collar capable of being secured to the frame of the forklift and a fastener for securing the mounting collar to the side plate, thereby securing the crusher head to the frame of the forklift.

8. A mobile apparatus for crushing a container comprising:

(a) a crusher head having, a head plate for crushing a container pressed against the head plate, at least two side plates connected to the head plate, the side plates each having at least one slot for accepting a fastener to attach each side plate to a frame of a forklift, and at least one support member connected on one end to a first side plate and connected on the other end to a second side plate; and (b) a crusher base having, two channels, each channel configured to accept a fork of the forklift, and a base plate connected to the channels for supporting the container while the fork of the forklift is actuated and driven toward the crusher head, thereby crushing the container.

9. The apparatus of claim 8 additionally including an angle member attached to the lower surface of the head plate for piercing the container.

10. The apparatus of claim 8 wherein, the head plate additionally includes discharge holes.

11. The apparatus of claim 8 additionally including a wood splitter member attached to the lower surface of the head plate for splitting wood placed on the upper surface of the crusher base when the forks of the forklift are actuated and driven toward the crusher head.

12. The apparatus of claim 8 additionally including at least one mounting collar capable of being secured to the fame of the forklift and two fasteners for securing the mounting collar to the side plates, thereby securing the crusher head to the frame of the forklift.

* * * * *